US005632694A

United States Patent [19]

Lee

[11] Patent Number: 5,632,694

[45] Date of Patent: May 27, 1997

[54] PUTTER

[76] Inventor: Doo-Pyung Lee, #108-410, Shinsigaji Apartment, 901, Mok6-dong, Yangchun-ku, Seoul, Rep. of Korea

[21] Appl. No.: 614,109

[22] Filed: Mar. 12, 1996

[30] Foreign Application Priority Data

Nov. 14, 1995 [KR] Rep. of Korea ..... 33435/1995
Nov. 14, 1995 [KR] Rep. of Korea ..... 33436/1995

[51] Int. Cl.[6] ..... A63B 53/04

[52] U.S. Cl. ..... 473/336; 473/340; 473/341

[58] Field of Search ..... 473/334, 335, 473/336, 337, 338, 339, 340, 341

[56] References Cited

U.S. PATENT DOCUMENTS

| | | |
|---|---|---|
| 1,575,364 | 3/1926 | Hodgkins . |
| 2,460,445 | 1/1949 | Bigler . |
| 2,750,194 | 6/1956 | Clark . |
| 3,606,327 | 9/1971 | Gorman . |
| 3,909,005 | 9/1975 | Piszel . |
| 4,508,342 | 4/1985 | Drake . |
| 4,895,371 | 1/1990 | Bushner . |
| 5,244,210 | 9/1993 | Au . |

FOREIGN PATENT DOCUMENTS

| | | | |
|---|---|---|---|
| 105959 | 11/1938 | Australia | 273/171 |
| 194823 | 3/1923 | United Kingdom | 273/171 |

*Primary Examiner*—Sebastiano Passaniti
*Attorney, Agent, or Firm*—Skjerven, Morrill, MacPherson, Franklin & Friel; Alan H. MacPherson; Thomas S. MacDonald

[57] ABSTRACT

A structurally improved putter is disclosed. The putter has a cylindrical head suitable to easily knock the central portion of a golf ball regardless of the putting postures of a golfer while putting. The head is provided with an internal cavity suitable to transmit the putting impact and vibrations of the head to the golfer's hands through the grip without failure. The cavity also allows the golfer to precisely feel both the putting senses and rolling directions of the ball thereby improving the putting precision of the golfer. The above putter head is provided with weights installed in the cavity. The weight of the above putter is easily adjusted by changing the number of weights.

8 Claims, 6 Drawing Sheets

PUTTER

BACKGROUND OF THE INVENTION

1. Field of the Invention

The present invention relates in general to putters and, more particularly, to a structural improvement in such putters for allowing the putter head to knock the center of a golf ball regardless of the golfer's putting postures and allowing the weight of the putter head to be freely adjusted by a golfer.

2. Description of the Prior Art

As well known to those skilled in the art, a putter is used for putting on a putting green. The term "putting" means that a golfer slightly knocks a golf ball on the putting green toward a hole on the putting green.

The construction of a typical putter is shown in FIG. 1A. As shown in the drawing, the head 50 of the typical putter has a generally-rectangular hexahedral configuration. The knocking surface of the putter head 50 is a flat surface. The handle 51 of the putter extends from the head 50. While putting, a golfer slightly swings the putter close to the green to knock the golf ball.

However, the above putter has the following problems.

That is, when a golfer putts with the above putter in a putting posture where he is leaning forward as shown in the left-handed phantom line of FIG. 1B, the putter head 50 knocks the upper portion of the golf ball, which is higher than the central portion of the ball, thereby increasing the frictional force between the ball and the green. In this case, the putting force of the golfer which should be precisely transmitted to the ball through the putter is somewhat lost, causing the ball to fail to roll on the green as desired.

When the golfer putts in a putting posture where he is leaning backward as shown in the right-handed phantom line of FIG. 1B, the putter head 50 knocks the lower portion of the golf ball, which is lower than the central portion of the ball, thereby causing the ball to take off. In this case, the ball fails to roll on the green well.

In this regard, the golfer with the above putter has to carefully and precisely hit the central portion of the ball in a fine putting posture as shown in the solid line of FIG. 1B while putting.

Another disadvantage of the above putter is caused by the fact that the putter has the solid head 50. That is, the solid head 50 of the above putter scarcely transmits the knocking impact of the head 50 to the handle 51 even when the golfer precisely knocks the central portion of the ball while putting. The golfer thus has dull putting senses and fails to putt precisely. In addition, the weight of the typical putters is fixed, so the golfers cannot use putters with a weight agreeable to one's own weight. This causes the golfers to putt unstably.

The above problems caused by the typical putters are linked directly with golfing score and makes it difficult for beginners to learn golfing.

SUMMARY OF THE INVENTION

It is, therefore, an object of the present invention to provide a structurally improved putter in which the above problems can be overcome and which is provided with a cylindrical head suitable to easily knock the central portion of a golf ball regardless of the putting postures of a golfer while putting.

It is another object of the present invention to provide a putter of which the head is provided with an internal cavity thereby transmitting the putting impact and vibrations of the head to the golfer's hands through the grip without failure and allowing the golfer to precisely feel both the putting senses and rolling directions of the ball and improving the putting precision.

It is a further object of the present invention to provide a putter which allows a golfer to easily adjust the weight of the putter in accordance with the putting conditions.

In order to accomplish the above objects, a putter in accordance with a preferred embodiment of the present invention comprises a cylindrical hollow head body having a cavity divided into parts by partition means, a pair of caps fitted into both ends of the cylindrical body thereby blocking the cavity of the head body, a rod axially extending from the center of an inside surface of each cap, an weight fitted over the rod inside the cavity and adapted for adjusting the weight of the head, and biasing means fitted over the rod in order to prevent the weight from moving inside the cavity.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1A:
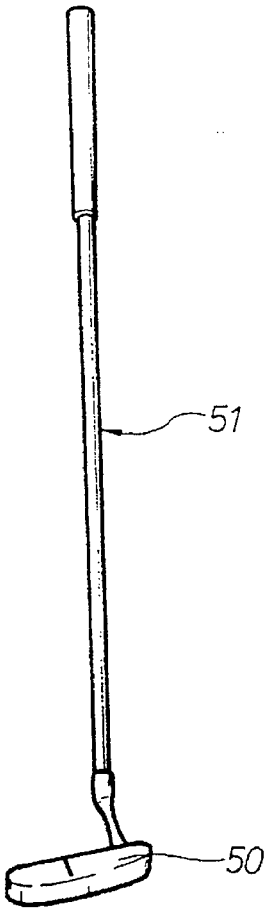
FIG. 1A PRIOR ART
FIG. 1A is a perspective view showing the construction of a typical putter.
Figure 1B:
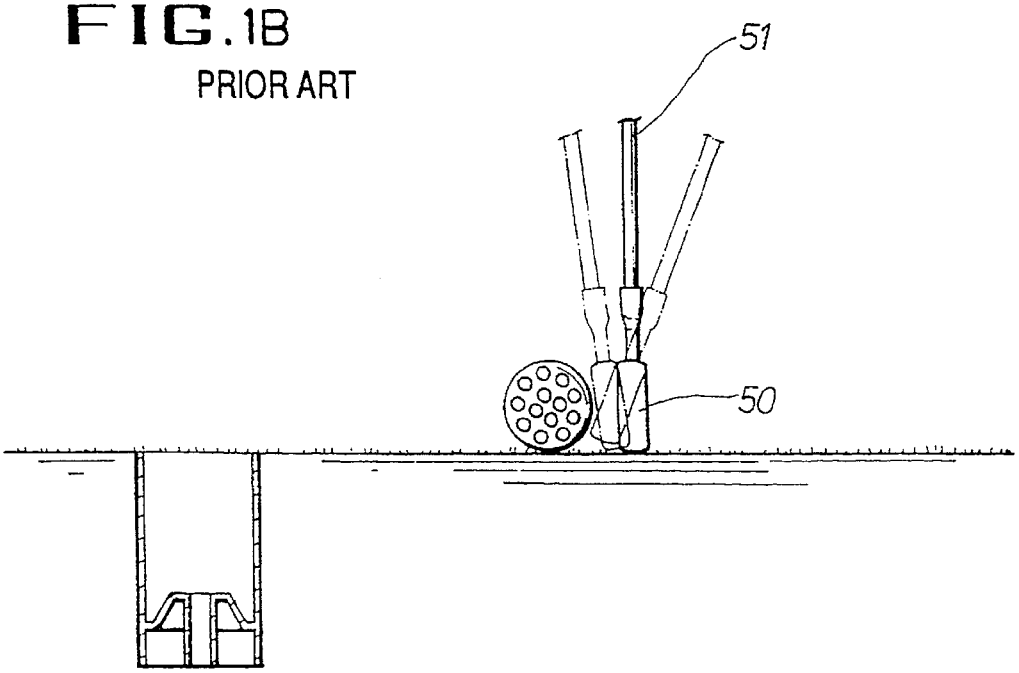
FIG. 1B PRIOR ART
FIG. 1B is a view showing the different knocking positions of the above putter relative to a golf ball in accordance with the putting postures of a golfer.
Figure 2:
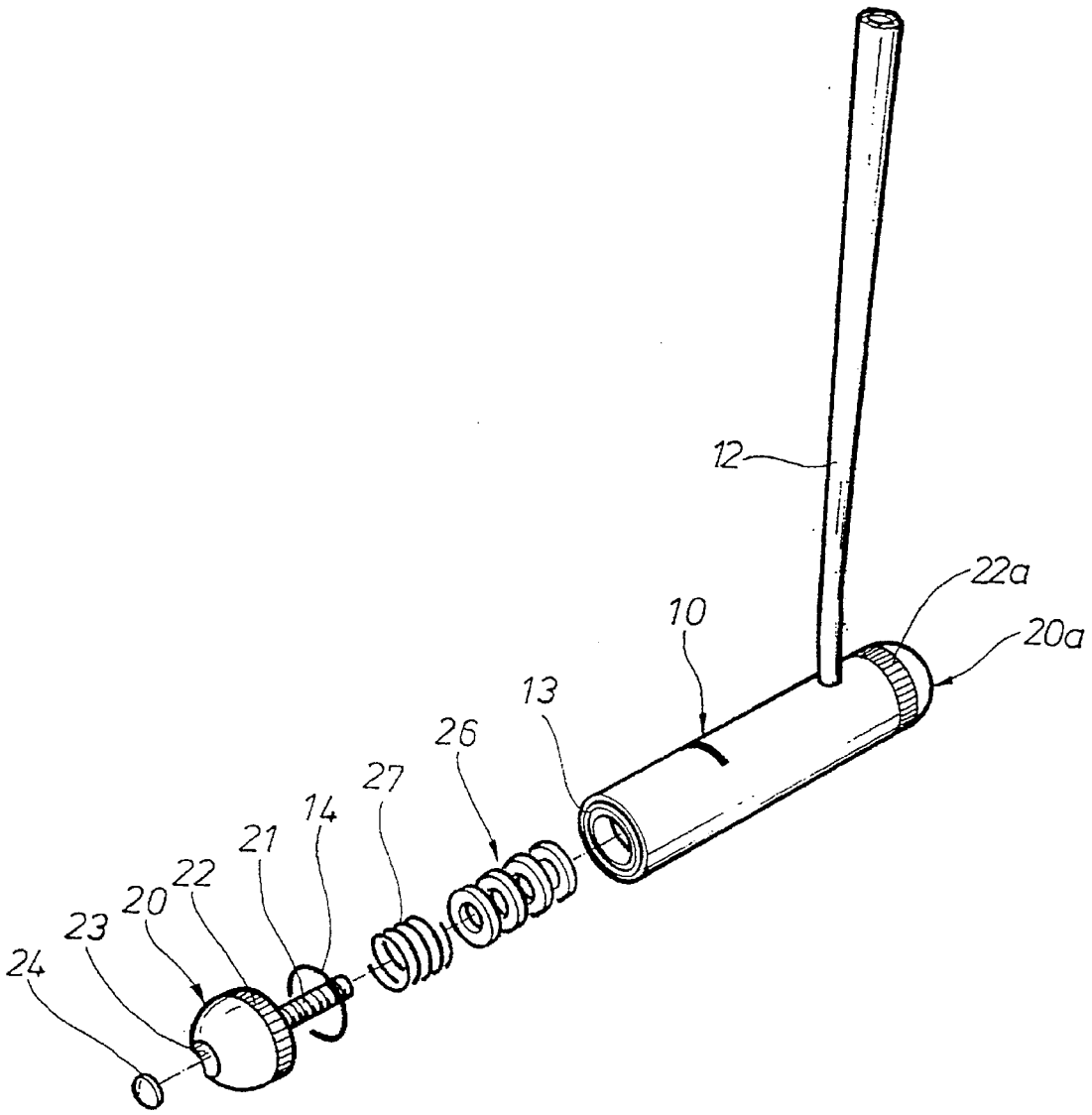
FIG. 2 is an exploded perspective view showing the construction of a putter in accordance with a primary embodiment of the present invention.
Figure 3:
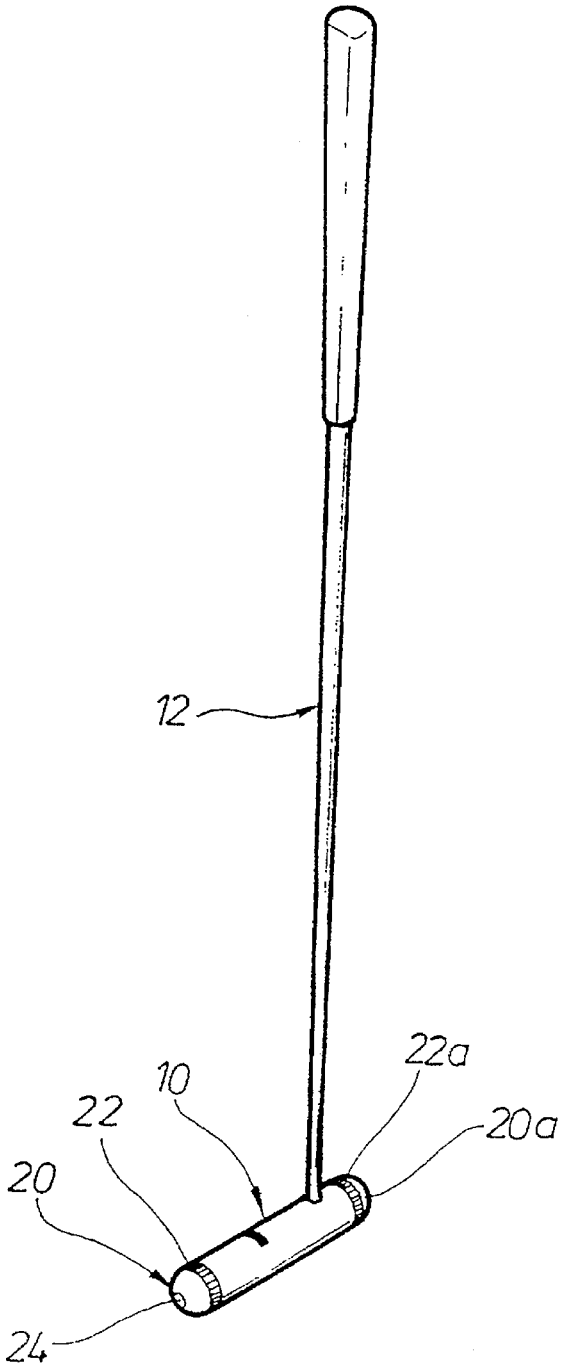
FIG. 3 is a perspective view of the assembled putter of FIG. 2.
Figure 4:
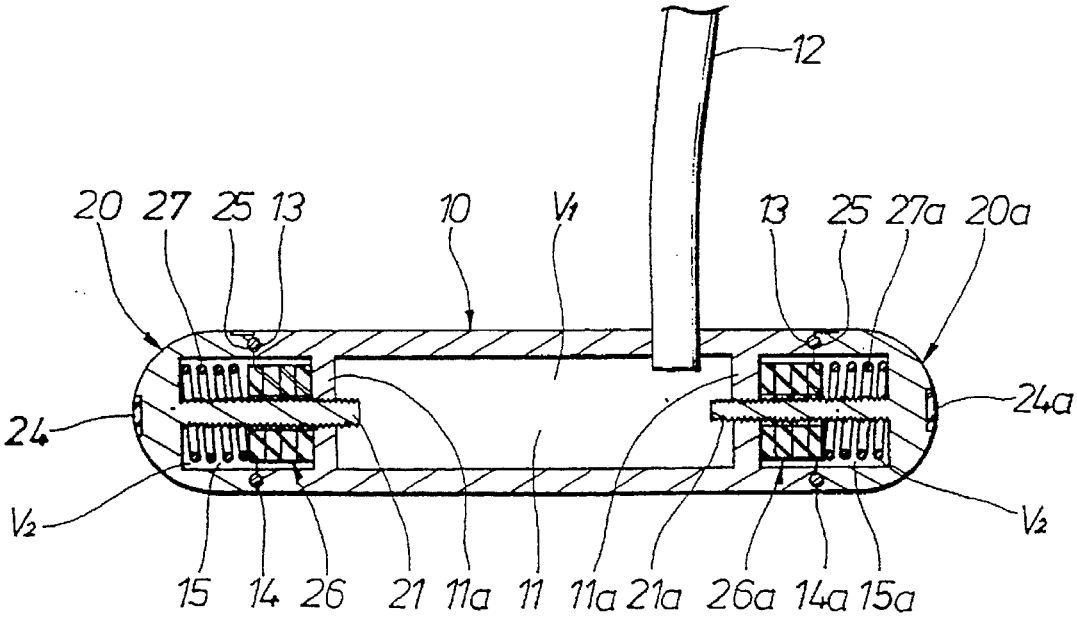
FIG. 4 is a sectional view of the head of the putter of FIG. 3.

FIGS. 2 to 4 show a putter in accordance with a primary embodiment of the present invention. As shown in the drawings, the head 10 of the putter according to the present invention has a hollow cylindrical head body having a diameter of 35 mm–45 mm, preferably 38 mm. In the above head body, a pair of vertical partitions 11*a* are placed in the front and rear portions inside the head body, thereby forming a central cavity 11 having a volume $V_1$. The cavity 11 has either circular or polygonal cross-section.

Each partition 11*a* has at least one threaded hole. The above threaded hole of each partition 11*a* engages with coupling means of a cap 20, 20*a* which will be described later herein. The caps 20 and 20*a* are coupled to the front and rear ends of the head body, respectively. Each cap 20, 20*a* cooperates with an associated partition 11*a* in order to form a side cavity having a volume $V_2$.

As shown in FIG. 2, a handle 12 extends from a given portion of the above head 10.

In the present invention, it is preferable to make the ratio of volume ($V_1$, $V_2$) of the cavities inside the head 10 be $V_1:V_2=2:1$. However, it should be understood that the volume ratio between the cavities may be changed without affecting the functioning of this invention. In addition, the head 10 may be provided with one or more partitions for forming the cavities.

In the above head 10, both ends of the above cylindrical head body are coupled to the hollow hemispherical caps 20 and 20*a*. Each cap 20, 20*a* has the above coupling means engaging with the threaded hole of an associated partition 11*a*. The above coupling means comprises a rod 21 which axially extends from the center of the inside surface of each cap 20, 20*a*. The above rod 21 is at least partially threaded in order to form a screw portion which will be threaded into the threaded hole of the partition 11*a*.

In accordance with the present invention, a plurality of annular weights 26 and 26*a* may be fitted over the rod 21 of each cap 20, 20*a*. Each weight 26, 26*a* has an inner diameter of larger than the outer diameter of the rod 21 and is used for adjusting the weight of the head 10.

In order to prevent the weights 26 and 26*a* from suddenly moving on the rods 21 and 21*a* of the caps 20*a* and 20*a*, it is preferable to fit a biasing means or a compression coil spring over each rod 21, 21*a* between the inside surface of an associated cap 20, 20*a* and the weights 26 and 26*a*.

As shown in FIG. 2, the peak of each hemispherical cap 20, 20*a* may be provided with a depression. A transparent tap 24 is fitted in the depression of the above cap 20, 20*a* with a label of a putter producer interposed between the tap 24 and depression. In this case, the putter will have an additional effect of showing the putter producer and good appearance.

In the present invention, an annular groove having a given depth is preferably formed on the coupling edge of each of the cap 20, 20*a* and the body 10. An O-ring 14, 14*a* formed of an appropriate material is fitted over the above annular grooves when the caps 20 and 20*a* are fitted into both ends of the head 10. The above O-ring 14, 14*a* prevents foreign substances such as moisture, grass and sand from being introduced into the cavity 11 of the head 10.

While putting, a golfer selects one of the putters having different weights in accordance with the putting conditions, such as the putting green conditions, that is, wet green or dry green, golfer's weight and the weather. While selecting the putters, a golfer selects a putter in accordance with one's subjective preference.

As described above, the putter head 10 of the present invention may be provided with the weights 26 and 26*a* for adjusting the weight of the putter head 10 as shown in FIGS. 2 to 4. In accordance with the primary embodiment of the invention, each weight has an annular configuration suitable to be fitted over the rod 21, 21*a*. However, it should be understood that there exist various polygonal configurations of each weight 26, 26*a* which yield the same result as that described for the primary embodiment without affecting the functioning of this invention. Each annular weight 26, 26*a* has an weight of 5–50 g, preferably 15 g. In the present invention, it is preferable to fit 0–20 weights 26 and 26*a*, preferably 10 weights, over each rod 21, 21*a*. However, a golfer may freely select the number of the weights 26 and 26*a*, which will be fitted over the rod 21, 21*a*, in accordance with one's preference. The net weight of the head 10 without having any weight 26, 26*a* is 250–300 g.

In order to install the weights 26, 26*a* in the head 10, the biasing means 27, 27*a* is fitted over the rod 21, 21*a* of each cap 20, 20*a* prior to fitting an appropriate number of weights 26 and 26*a* over the rod 21, 21*a*. After fitting the weights 27 and 27*a* over the rods 21 and 21*a* of the caps 20 and 20*a*, the caps 20 and 20*a* are tightly fitted into both ends of the head 10, respectively. Of course, the weights 26 and 26*a* may be exclusively fitted over the rod 21, 21*a* of either cap 20 or 20*a*.

The above biasing means 27 and 27*a* interposed between the inside surfaces of the caps 20 and 20*a* and the weights 26 and 26*a* prevent the weights 26 and 26*a* from moving on the rods 21 and 21 inside the head 10. In addition, A plurality of O-rings (not shown) formed of elastic rubber may be interposed between the weights 26 and 26*a* in order to prevent noises generated from the weights 26 and 26*a* while putting.

In the present invention, it is preferable to fit the caps 20 and 20*a* into both ends of the head 10 through screw-type fitting. In order to achieve the above screw-type fitting of the caps 20 and 20*a* into the head 10, the fitting edges of the caps 20 and 20*a* and of the head 10 are preferable provided with threaded portions. Of course, the caps 20 and 20*a* may be fitted into both ends of the head 10 through another method, such as interference fit. In order to make it easy to fit the caps 20 and 20*a* into both ends of the head 10, the fitting edge of each cap 20, 20*a* is preferably provided with a knurled portion 22, 22*a*.

Figure 5:
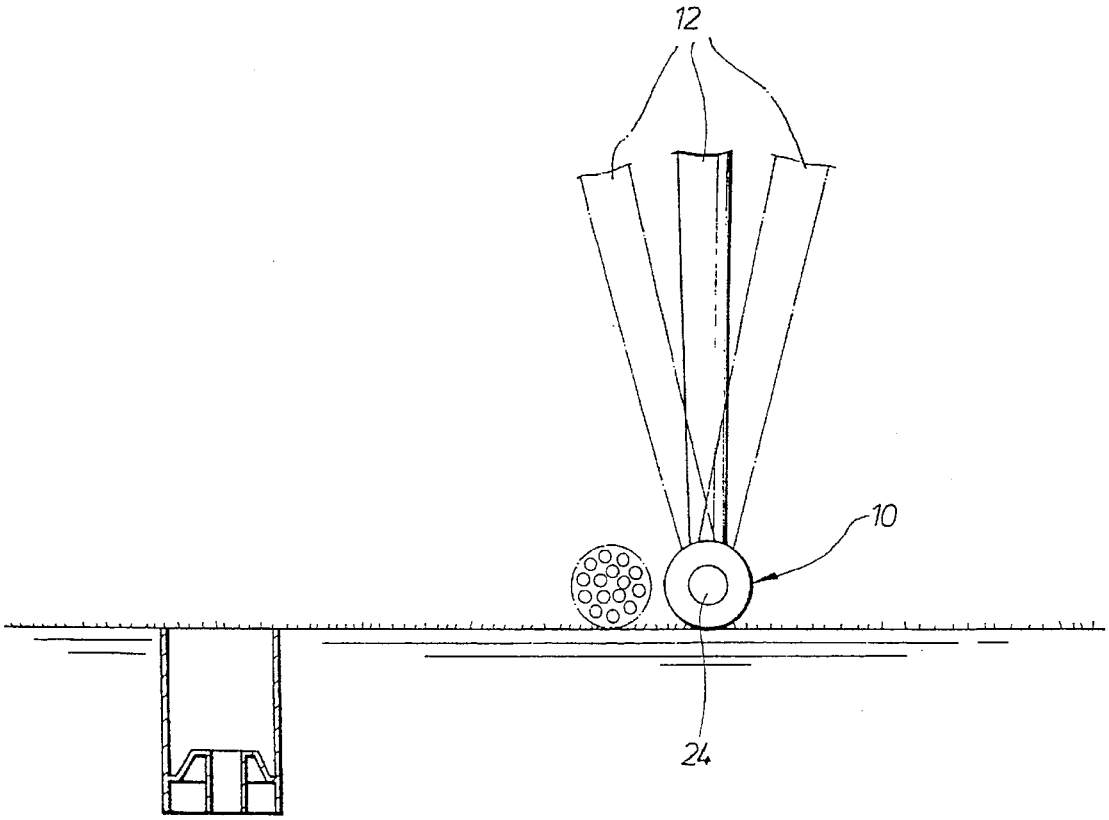
FIG. 5 is a view corresponding to FIG. 1B, but showing the putter of this invention.
Figure 6:
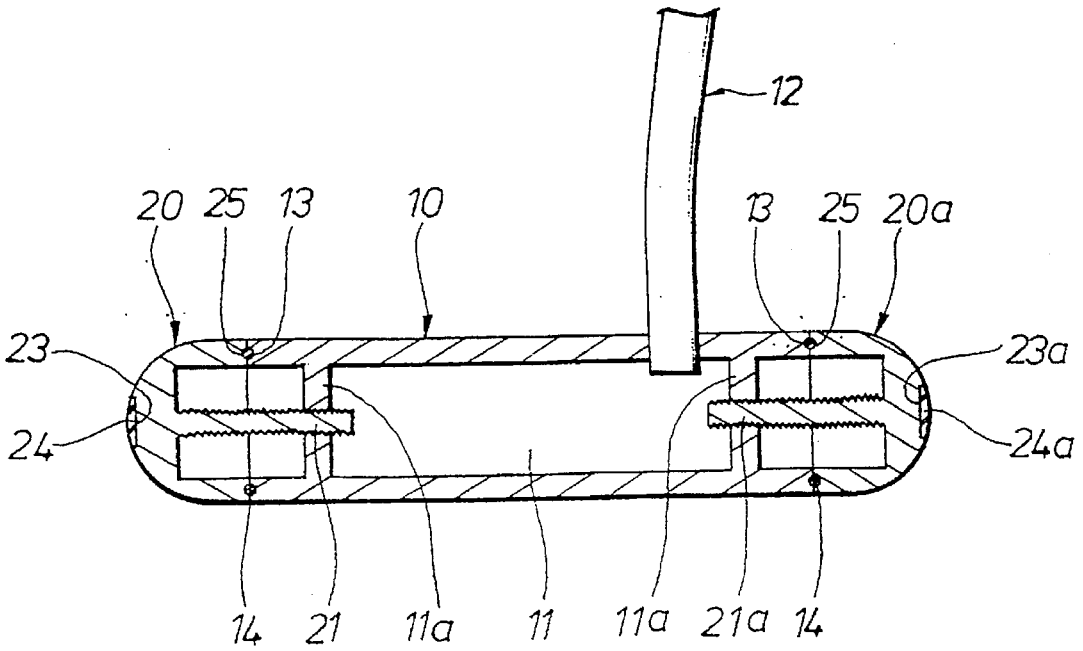
FIG. 6 is a view corresponding to FIG. 4, but showing another embodiment of this invention.

The putter head 10 of the present invention is a cylindrical body. With the cylindrical body of the head 10, the putter head 10 knocks the center of a golf ball regardless of the putting postures of a golfer while putting as shown in FIG. 5. The putting force of the golfer is thus precisely transmitted to the ball through the putter regardless of the golfer's putting postures, thereby improving the putting precision of the golfer.

As described above, the present invention provides a structurally improved putter. The head of the above putter is a cylindrical body with a cavity. With the cylindrical configuration of the putter head, the putter head knocks the center of a golf ball regardless of the golfer's putting postures while putting. A plurality of annular weights are provided in the cavity of the head. The number of the weights in the head can be freely changed by a golfer thereby freely adjusting the weight of the head. The above weights are prevented from moving in the cavity by a biasing means.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A putter comprising:

a head including:

a cylindrical hollow head body having a cavity, said cavity being divided into parts by a pair of circular fixed integral vertical spaced partitions, each partition having a threaded hole;

a pair of hollow caps screw-fitted into both ends of said cylindrical head body thereby closing the cavity of the head body;

a threaded rod axially extending from the center of an inside surface of each cap and threaded into respective ones of the threaded holes;

at least one weight fitted over each of said rods inside said cavity and between an interior surface of each cap and an outwardly facing surface of a respective spaced partition for adjusting the weight of said head; and biasing means fitted over said rods in order to prevent said weights from moving inside said cavity.

2. The putter according to claim 1, wherein said cylindrical head body has a diameter of 35–45 mm.

3. The putter according to claim 1, wherein said cavity has a cylindrical cross-section.

4. The putter according to claim 1, wherein each of said caps has a hemispherical configuration.

5. The putter according to claim 1 or 4, wherein said rod of each cap is externally threaded.

6. The putter according to claim 1, wherein said biasing means is a coil spring.

7. The putter according to claim 1, wherein an O-ring is interposed between said head and each cap.

8. The putter according to claim 1, wherein said at least one weight has a weight of 5–50 g.

* * * * *